US010488788B2

(12) United States Patent
Mitsui et al.

(10) Patent No.: US 10,488,788 B2
(45) Date of Patent: Nov. 26, 2019

(54) TRANSFER MEMBER FOR IMAGE FORMING DEVICE

(71) Applicant: Gunze Limited, Ayabe-shi, Kyoto (JP)

(72) Inventors: Satoshi Mitsui, Konan (JP); Yuki Okazaki, Konan (JP)

(73) Assignee: Gunze Limited, Osaka (JP)

( * ) Notice: Subject to any disclaimer, the term of this patent is extended or adjusted under 35 U.S.C. 154(b) by 0 days.

(21) Appl. No.: 15/761,057

(22) PCT Filed: Sep. 16, 2016

(86) PCT No.: PCT/JP2016/077438
§ 371 (c)(1),
(2) Date: Mar. 16, 2018

(87) PCT Pub. No.: WO2017/047746
PCT Pub. Date: Mar. 23, 2017

(65) Prior Publication Data

US 2018/0267434 A1 Sep. 20, 2018

(30) Foreign Application Priority Data

Sep. 18, 2015 (JP) ..... 2015-185835

(51) Int. Cl.
*G03G 15/16* (2006.01)

(52) U.S. Cl.
CPC ..... *G03G 15/162* (2013.01); *G03G 15/163* (2013.01); *G03G 2215/1676* (2013.01); *G03G 2215/2016* (2013.01)

(58) Field of Classification Search
CPC ..... G03G 15/162; G03G 15/163; G03G 2215/1676; G03G 2215/2061
See application file for complete search history.

(56) References Cited

U.S. PATENT DOCUMENTS

2004/0031439 A1 2/2004 Shimizu et al.
2010/0303498 A1 12/2010 Takazawa
(Continued)

FOREIGN PATENT DOCUMENTS

EP 1 327 917 A1 9/2001
EP 2 003 515 A1 12/2008
(Continued)

OTHER PUBLICATIONS

International Search Report for International Application No. PCT/JP2016/077438 dated Oct. 11, 2016 in 2 pages.
(Continued)

*Primary Examiner* — David M. Gray
*Assistant Examiner* — Michael A Harrison
(74) *Attorney, Agent, or Firm* — Knobbe, Martens, Olson & Bear LLP

(57) ABSTRACT

The purpose of the present invention is to provide a transfer member for an image forming device for which the transfer properties for recording media having recesses and protrusions on the surface, such as embossed paper, are superior. The transfer member for an image forming device is characterized by including a base material layer and a coating layer formed from an inorganic/organic hybrid material provided on the surface of the base material layer, the thickness of the coating layer being 10 μm or less, and the micro hardness of the coating layer surface being 140 mN/mm2 or greater when measured by a method complying with ISO 14577-1 using a Berkovich indenter with a pressing depth of 0.05 μm.

9 Claims, 1 Drawing Sheet

(56) References Cited

U.S. PATENT DOCUMENTS

| | | | | |
|---|---|---|---|---|
| 2015/0323888 | A1* | 11/2015 | Sakamoto | G03G 15/162 428/411.1 |
| 2016/0170333 | A1* | 6/2016 | Tsuji | G03G 15/162 428/411.1 |
| 2018/0011416 | A1* | 1/2018 | Horiuchi | C08L 21/00 |

FOREIGN PATENT DOCUMENTS

| | | | | |
|---|---|---|---|---|
| JP | 2001-222176 | A | | 8/2001 |
| JP | 2002-006667 | A | | 1/2002 |
| JP | 2009-192901 | A | | 8/2009 |
| JP | 2010-277034 | A | | 12/2010 |
| JP | 2011-059477 | A | | 3/2011 |
| JP | 2011059477 | A | * | 3/2011 |
| JP | 2012-068344 | A | | 4/2012 |
| JP | 2012-093645 | A | | 5/2012 |
| JP | 2013-024898 | A | | 2/2013 |
| JP | 2013-088599 | A | | 5/2013 |
| WO | WO 02/23280 | A1 | | 3/2002 |

OTHER PUBLICATIONS

Supplementary European Search Report in corresponding European Application No. EP 16 84 6617, dated Mar. 26, 2019.

* cited by examiner

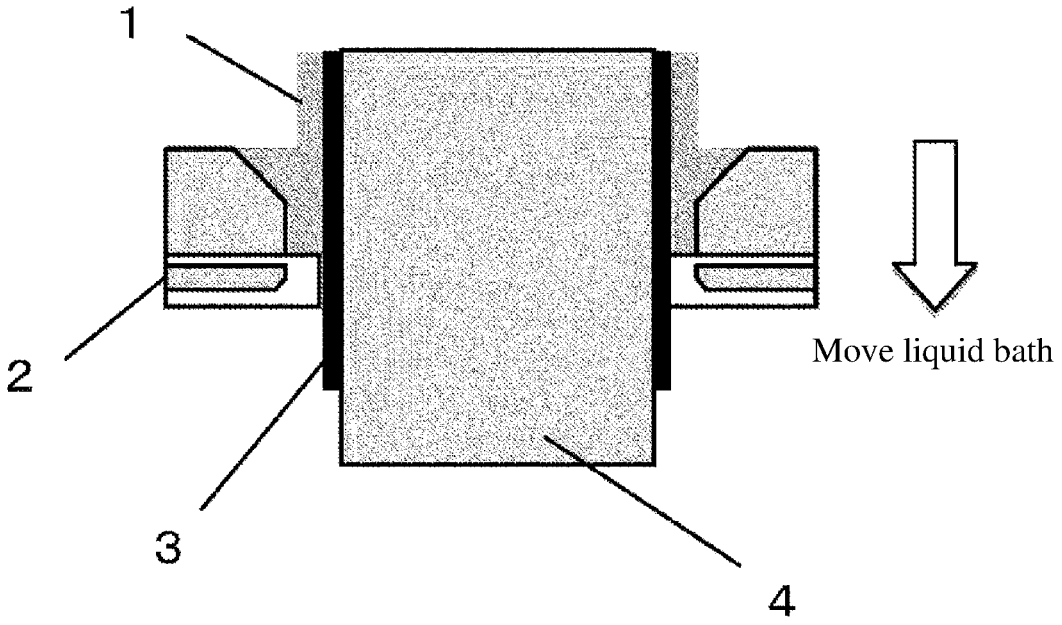
1
2
3
4
Move liquid bath

TRANSFER MEMBER FOR IMAGE FORMING DEVICE

TECHNICAL FIELD

The present invention relates to a transfer member for an image forming apparatus, such as an intermediate transfer belt. Specifically, the present invention relates to a transfer member for an image forming apparatus which is excellent in transfer property to a recording medium having an irregular shape on a surface thereof.

BACKGROUND ART

In an image forming apparatus such as a copying machine, a printer or facsimile equipment, first an electrostatic latent image formed on an image carrier is developed with a toner, the developed toner image is transferred onto a recording medium directly or through an intermediate transfer belt or the like, and an image is fixed on the recording medium by heating and pressurizing the unfixed toner image on the recording medium using a fixing belt or a roller.

In the image forming apparatus, various transfer/fixing members are used such as an intermediate transfer belt that transfers a toner to a recording medium such as paper, and a fixing belt that heats and fixes a toner image transferred from the intermediate transfer belt to the recording medium.

For example, an intermediate transfer belt as a transfer member plays a role of attracting a toner on a photoconductor to the belt (primary transfer), and transferring the toner to a recording medium (secondary transfer). The intermediate transfer belt moves the toner by means of an electrostatic force. Thus, the intermediate transfer belt is required to precisely control conductivity, and in general, conductivity is controlled by, for example, a method in which a resin as a base material of the belt is mixed with a conducting agent to impart conductivity.

For the transfer member, various methods have been studied for improving performance such as heat resistance, durability or toner releasability for the purpose of improving the image quality of an image obtained by the image forming apparatus. As one of the methods, formation of a coating layer composed of an inorganic-organic hybrid material on a substrate of a transfer member by a sol-gel method is known.

For example, Patent Document 1 discloses a transfer/fixing member for an electrophotography apparatus which includes a substrate, and a coating layer composed of an inorganic-organic hybrid material formed on the substrate by a sol-gel method, so that the transfer/fixing member for an electrophotography apparatus has heat resistance, durability and improved toner releasability.

In addition, for example, Patent Document 2 discloses a transfer/fixing member for an electrophotography apparatus which includes a substrate, and a coating layer composed of an inorganic-organic hybrid material formed on the substrate by a sol-gel method, and has a surface roughness Rz of 15 μm or less, so that the transfer/fixing member for an electrophotography apparatus has heat resistance, durability and reduced image quality defects.

In addition, for example, Patent Document 3 discloses a transfer/fixing member for an electrophotography apparatus in which an inorganic-organic hybrid material release layer having a fluoroalkyl group is formed on a substrate surface by a sol-gel method, so that the transfer/fixing member for an electrophotography apparatus has heat resistance, durability and improved toner releasability.

PRIOR ART DOCUMENTS

Patent Documents

Patent Document 1: Japanese Patent Laid-open Publication No. 2001-222176

Patent Document 2: Japanese Patent Laid-open Publication No. 2002-6667

Patent Document 3: International Publication No. WO 2002/23280

SUMMARY OF THE INVENTION

Problems to be Solved by the Invention

Paper or the like is used as a recording medium for an image forming apparatus. Particularly, in recent years, paper etc. with irregularities formed on a surface thereof to improve designability, such as embossed paper, has been used as a recording medium. However, formation of an image on such paper having irregularities on a surface thereof as described above has the problem that with a conventional transfer member, followability to a recording medium is insufficient, and thus secondary transfer property is deteriorated, leading to occurrence of image quality defects such as distortion and positional displacement of a toner image.

In view of the above-described situations, an object of the present invention is to provide a transfer member for an image forming apparatus which is excellent in transfer property to a recording medium having irregularities on a surface thereof, such as embossed paper.

Means for Solving the Problems

In view of the above-mentioned problems, the present inventors have extensively conducted studies, and found that when a transfer member for an image forming apparatus includes a base material layer, and a coating layer provided on a surface of the base material layer and composed of an inorganic-organic hybrid material, and the thickness of the coating layer and the microhardness of a surface of the coating layer each fall within a specific range, transfer property to a recording medium having irregularities on a surface thereof can be improved. In addition, the present inventors have found that a transfer member satisfying the above-mentioned configuration is also excellent in durability. The present invention has been completed by further conducting studies on the basis of the above-mentioned findings.

That is, the present invention provides an invention having the aspects described below.

Item 1. A transfer member for an image forming apparatus including a base material layer, and a coating layer provided on a surface of the base material layer and composed of an inorganic-organic hybrid material, the coating layer having a thickness of 10 μm or less, the coating layer having a surface having a microhardness of 140 $mN/mm^2$ or more as measured at an indentation depth of 0.05 μm with a Berkovich indenter by a method conforming to ISO 14577-1.

Item 2. The transfer member for an image forming apparatus according to item 1, wherein the inorganic-organic hybrid material is obtained by reaction of an alkoxide of a metal or semimetal with an organosilicon compound or a fluorine-substituted organosilicon compound.

Item 3. The transfer member for an image forming apparatus according to item 1 or 2, wherein the surface of the coating layer has a pencil hardness of 4H or more.

Item 4. The transfer member for an image forming apparatus according to any one of items 1 to 3, wherein a resin that forms the base material layer is at least one selected from the group consisting of a polyimide, a polyamideimide and a polyamide.

Item 5. The transfer member for an image forming apparatus according to any one of items 1 to 4, wherein the base material layer has a thickness of 30 to 160 μm.

Item 6. The transfer member for an image forming apparatus according to any one of items 1 to 5, which has a surface resistivity is $1\times10^{9}$ to $1\times10^{14}$ Ω/□.

Item 7. The transfer member for an image forming apparatus according to any one of items 1 to 6, which has a volume resistivity of $1\times10^{8}$ to $1\times10^{14}$ Ω·cm.

Item 8. Use of a laminate as a transfer member for an image forming apparatus, the laminate including a base material layer, and a coating layer provided on a surface of the base material layer and composed of an inorganic-organic hybrid material, the coating layer having a thickness of 10 μm or less, the coating layer having a surface having a microhardness of 140 mN/mm$^2$ or more as measured at an indentation depth of 0.05 μm with a Berkovich indenter by a method conforming to ISO 14577-1.

Item 9. A method for producing the transfer member for an image forming apparatus according to any one of items 1 to 7, the method including the following steps (1) and (2):

(1) forming a belt-shaped base material layer using a base material layer forming composition; and (2) forming a coating layer by applying a sol liquid of an inorganic-organic hybrid material to a surface of the belt-shaped base material layer formed in the step (1).

Hereinafter, the present invention will be described in detail.

Advantages of the Invention

According to the present invention, there can be provided a transfer member for an image forming apparatus which is excellent in transfer property to a recording medium having irregularities on a surface thereof, such as embossed paper.

BRIEF DESCRIPTION OF THE DRAWINGS

FIG. 1 is a schematic sectional view showing a method for preparing a coating layer in an example.

EMBODIMENTS OF THE INVENTION

1. Transfer Member for Image Forming Apparatus

A transfer member for an image forming apparatus according to the present invention includes a base material layer, and a coating layer provided on a surface of the base material layer and composed of an inorganic-organic hybrid material, the coating layer having a thickness of 10 μm or less, the coating layer having a surface having a microhardness of 140 mN/mm$^2$ or more as measured at an indentation depth of 0.05 μm with a Berkovich indenter by a method conforming to ISO 14577-1.

The transfer member for an image forming apparatus according to the present invention includes a base material layer and a coating layer. Each layer will be described in detail below.

(a) Base Material Layer

The base material layer in the transfer member for an image forming apparatus according to the present invention is composed of a material excellent in durability against an external force of tension, compression or the like in order to avoid deformation of a belt by stress applied at the time of driving. The base material layer is formed from a base material layer forming composition containing a resin as described later.

The resin that forms the base material layer is not particularly limited as long as it is a resin capable of satisfying physical properties required for the base material layer of the transfer member (e.g. intermediate transfer belt) for an image forming apparatus, and examples thereof may include polyimides, polyamideimides, polycarbonates, polyvinylidene fluorides (PVdF), ethylene-tetrafluoroethylene copolymers, polyamides and polyphenylene sulfides. One of these resins may be selected and used singly, or a mixture of two or more of these resins may be used. Among these resins, at least one selected from the group consisting of a polyimide, a polyamideimide and a polyamide is preferable.

The polyimide to be used for forming the base material layer is usually produced by polycondensation of a tetracarboxylic acid dianhydride and a diamine or a diisocyanate as monomer components by a known method.

The type of the tetracarboxylic acid dianhydride is not particularly limited, and examples thereof include acid dianhydrides of pyromellitic acid, naphthalene-1,4,5,8-tetracarboxylic acid, naphthalene-2,3,6,7-tetracarboxylic acid, 2,3,5,6-biphenyltetracarboxylic acid, 2,2',3,3'-biphenyltetracarboxylic acid, 3,3',4,4'-biphenyltetracarboxylic acid, 3,3',4,4'-diphenyl ether tetracarboxylic acid, 3,3',4,4'-benzophenonetetracarboxylic acid, 3,3',4,4'-diphenylsulfonetetracarboxylic acid, azobenzene-3,3',4,4'-tetracarboxylic acid, bis(2,3-dicarboxyphenyl)methane, bis(3,4-dicarboxyphenyl)methane, β,β-bis(3,4-dicarboxyphenyl)propane, β,β-bis(3,4-dicarboxyphenyl) hexafluoropropane and the like. These tetracarboxylic dianhydrides may be used singly, or used in combination of two or more thereof.

The type of the diamine is not particularly limited, and examples thereof include m-phenylenediamine, p-phenylenediamine, 2,4-diaminotoluene, 2,6-diaminotoluene, 2,4-diaminochlorobenzene, m-xylylenediamine, p-xylylenediamine, 1,4-diaminonaphthalene, 1,5-diaminonaphthalene, 2,6-diaminonaphthalene, 2,4'-diaminobiphenyl, benzidine, 3,3'-dimethylbenzidine, 3,3'-dimethoxybenzidine, 3,4'-diaminodiphenyl ether, 4,4'-diaminodiphenyl ether (ODA), 4,4'-diaminodiphenyl sulfide, 3,3'-diaminobenzophenone, 4,4'-diaminodiphenyl sulfone, 4,4'-diaminoazobenzene, 4,4'-diaminodiphenylmethane and β,β-bis (4-aminophenyl) propane. These diamines may be used singly, or used in combination of two or more thereof.

Examples of the diisocyanate include compounds in which an amino group in the diamine component is substituted with an isocyanate group.

In addition, the polyamideimide to be used for forming the base material layer is produced by polycondensation of trimellitic acid and a diamine or a diisocyanate by a known method. Here, as the diamine or diisocyanate, one identical to the raw material of the polyimide can be used. A solvent to be used in polycondensation may be one that is the same as in the case of the polyimide.

The polyamide to be used for forming the base material layer is not particularly limited, and various known polyamides can be used. Examples thereof include aliphatic polyamides such as polyamide 6 (poly(ε-caprolactam)), polyamide 66 (polyhexamethylene adipamide), polyamide 610 (polyhexamethylene sebacamide), polyamide 11 (poly (undecane lactam)), polyamide 12 (poly (lauryl lactam)) and the like, and copolymers thereof, for example polyamide 6-66 copolymers, polyamide 6-610 copolymers and the like. These polyamides can be used singly, or used in combination of two or more thereof.

In particular, it is preferable to use a polyamide having a small water absorption ratio. By using a polyamide having a small water absorption ratio, dimensional variations depending on an environment can be suppressed. In addition, when conductivity is imparted to the base material layer, variations in electric resistance depending on an environment can be reduced. As used herein, the water absorption ratio refers to a weight gain per unit weight of a sample after the sample is dried in a drying oven at 100° C. for 24 hours, and then left standing under an environment at 23° C. and 50% RH for 24 hours. The water absorption ratio is 1.0 wt % or less, preferably 0.8 wt % or less.

Examples of the polyamide having a small water absorption ratio (1.0 wt % or less) include polyamide 11 (water absorption ratio: 0.9 wt %) and polyamide 12 (water absorption ratio: 0.8 wt %). Polyamide 12 is especially preferable.

In addition, the base material layer may contain a conducting agent. Preferably, the base material layer contains a conducting agent for imparting conductivity suitable for the transfer member for an image forming apparatus according to the present invention. Examples of the conducting agent include conductive carbon-based materials such as carbon black and graphite; metals or alloys such as aluminum and copper alloys; and conductive metal oxides such as tin oxide, zinc oxide, antimony oxide, indium oxide, potassium titanate, antimony oxide-tin oxide composite oxide (ATO) and indium oxide-tin oxide composite oxide (ITO). These conducting agents may be used singly, or used in combination of two or more thereof. Among these conducting agents, conductive carbon-based materials are preferable, and carbon black is more preferable.

The content ratio of the conducting agent in the base material layer is not particularly limited, and is, for example, 5 to 30% by mass.

The thickness of the base material layer can be appropriately set in consideration of durability against stress and external forces applied to the belt at the time of driving, and is, for example, 30 to 160 μm, preferably 30 to 120 μm, more preferably 50 to 100 μm.

The base material layer can be formed by molding a base material layer forming composition containing a resin, a solvent, and an additive added as necessary, into a desired belt shape.

For example, when a base material layer containing a polyimide is formed, it is preferable to use a base material layer forming composition obtained by reacting a tetracarboxylic acid dianhydride with a diamine in a solvent to form a polyamic acid solution on a temporary basis, and dispersing optionally added additives in the polyamic acid solution.

Examples of the solvent to be used in the polyamic acid solution include aprotic organic polar solvents such as N-methyl-2-pyrrolidone (NMP), N,N-dimethylformamide, N,N-diethylformamide, N, N-dimethylacetamide, dimethylsulfoxide, hexamethylphosphoamide and 1,3-dimethyl-2-imidazolidinone. These solvents may be used singly, or used in combination of two or more thereof. Among these solvents, NMP is preferable.

The solid content concentration in the base material layer forming composition is not particularly limited, and is, for example, 10 to 40% by mass. Here, the solid content concentration refers to a concentration of the total of components forming the base material layer, i.e. a concentration of components other than components which are volatilized and removed during formation of the base material layer in the base material layer forming composition.

The method for preparing the base material layer forming composition is not particularly limited, and examples thereof include a method in which materials such as a resin, a solvent, and additives (conducting agent etc.) added as necessary are blended, and then mixed using a ball mill etc.

(b) Coating Layer

The coating layer in the transfer member for an image forming apparatus according to the present invention is a layer for holding a toner directly thereon, transferring the toner to a recording medium, and releasing the toner. Thus, in the transfer member for an image forming apparatus according to the present invention, the coating layer is provided on at least a base material layer surface which is in contact with the toner.

In the transfer member for an image forming apparatus according to the present invention, the coating layer is composed of an inorganic-organic hybrid material, and has a thickness of 10 μm or less, and a surface of the coating layer has a microhardness of 140 $mN/mm^2$ or more as measured at an indentation depth of 0.05 μm with a Berkovich indenter by a method conforming to ISO 14577-1. The transfer member for an image forming apparatus according to the present invention includes a coating layer composed of such a specific material and having a thickness and a surface microhardness each falling within a specific range, and therefore is excellent in transfer property to a recording medium having irregularities on a surface thereof. The reason why the transfer member for an image forming apparatus according to the present invention is excellent in transfer property is that the coating layer in the present invention has a high hardness and conductivity. Thus, it is supposed that since the coating layer is provided, the local conductivity and the hardness of the base material layer are made uniform, resulting in improvement of the transfer property of the transfer member. In addition, the transfer member for an image forming apparatus according to the present invention is also excellent in durability.

The transfer member for an image forming apparatus according to the present invention has a microhardness of 140 $mN/mm^2$ or more at the surface of the coating layer. The microhardness is a value measured by a method conforming to ISO 14577-1 under the condition of an indentation depth of 0.05 μm using a Berkovich indenter.

From the viewpoint of further excellent transfer property and durability, the value of the microhardness is more preferably from 140 to 600 $mN/mm^2$, still more preferably from 300 to 600 $mN/mm^2$.

When the base material layer is formed of a polyimide, the microhardness is preferably 300 $mN/mm^2$ or more, more preferably 300 to 600 $mN/mm^2$, from the viewpoint of improving the secondary transfer property of the transfer member according to the present invention.

The thickness of the coating layer is 10 μm or less. When the thickness is 10 μm or less, the coating layer can be made to have a microhardness falling within the above-mentioned range. The thickness of the coating layer is preferably from 1 to 10 μm, more preferably from 1 to 6.5 μm, from the viewpoint of further excellent durability of the transfer member according to the present invention.

(Inorganic Organic Hybrid Material)

The coating layer is composed of an inorganic-organic hybrid material. The transfer member according to the present invention is also excellent in durability because it includes a coating layer formed from an inorganic-organic hybrid material. In addition, since formation of the coating layer has only a small influence on the conductivity of the base material layer, the transfer member can appropriately retain required conductivity. Preferably, the coating layer is formed from an inorganic-organic hybrid material by a sol-gel method. In the sol-gel method, a sol liquid is applied to a surface of the base material layer, and the sol liquid is then subjected to a dehydration treatment (heating treatment) to be gelled, so that a coating layer is formed.

The inorganic-organic hybrid material that forms the coating layer is preferably one obtained by reaction of an alkoxide of a metal or semimetal as an inorganic component with an organosilicon compound, fluorine-substituted organosilicon compound or the like as an organic component.

Examples of the metal or semimetal that forms an alkoxide include metals and semimetals capable of forming an alkoxide, such as aluminum, silicon, titanium, vanadium, manganese, iron, cobalt, zinc, germanium, yttrium, zirconium, niobium, cadmium and tantalum.

The type of the alkoxide is not particularly limited, and examples thereof include methoxide, ethoxide, propoxide and butoxide, and may include alkoxide derivatives with alkoxide groups partially substituted with a β-diketone, a β-ketoester, an alkanolamine, an alkylalkanolamine or the like.

As the organosilicon compound, for example, a dialkyldialkoxysilane, a terminal silanol polydimethylsiloxane or the like can be used. Examples of the dialkyldialkoxysilane include dimethyldimethoxysilane, dimethyldiethoxysilane, dimethyldipropoxysilane, dimethyldibutoxysilane, diethyldimethoxysilane, diethyldiethoxysilane, diethyldipropoxysilane, diethyldibutoxysilane, dipropyldimethoxysilane, dipropyldiethoxysilane, dipropyldipropoxysilane, dipropyldibutoxysilane, diphenyldimethoxysilane, diphenyldiethoxysilane, diphenyldipropoxysilane and diphenyldibutoxysilane. The terminal silanol polydimethylsiloxane is preferably one having a molecular weight of 400 to 10000.

Examples of the fluorine-substituted organosilicon compound may include the above-mentioned organosilicon compounds of which hydrogen is substituted with fluorine. Examples of the compound include $CF_3CH_2CH_2$—Si $(OC_2H_5)_3$.

For forming the coating layer, first a hydrolysate of the alkoxide of the metal or semimetal is reacted with an organic component of the organosilicon compound or the fluorine-substituted organosilicon compound to prepare a sol liquid. The organic component may be blended with the alkoxide before hydrolysis, or blended with the hydrolyzed alkoxide.

The solvent to be used here is not particularly limited as long as it is a solvent capable of uniformly dispersing and dissolving the alkoxide and the organic component, and examples thereof include various kinds of alcohols such as methanol and ethanol, acetone, toluene and xylene. A catalyst such as hydrochloric acid, phosphoric acid or acetic acid may be appropriately used for accelerating the hydrolysis reaction of the alkoxide.

When the terminal silanol polydimethylsiloxane is reacted with the alkoxide, the alkoxy group of the alkoxide is substituted with a hydroxyl group, the hydroxyl group undergoes a dehydration/condensation reaction with the terminal silanol group of the terminal silanol polydimethylsiloxane to form an elastomer.

The adhesion of the thus-obtained sol liquid to the base material layer can be improved by sufficiently hydrolyzing the alkoxide by stirring or the like, and performing partial dehydration/polymerization.

As a method for applying the resulting sol liquid to a surface of the base material layer, a known method can be used. For example, a method such as dip coating, spray coating, roll coating, flow coating or the like can be used.

The sol liquid applied to the surface of the base material layer is dehydrated/dried to be ultimately formed into a coating layer. The dehydration/drying may be performed by natural drying, but is usually performed by a heating treatment. The conditions for the heating treatment are not particularly limited as long as it is possible to form a coating layer having a micro hardness falling within a predetermined range, and the heating treatment can be normally performed at 60 to 450° C. for 20 seconds to 7 hours. The number of times that the coating step is carried out is not limited to 1, and may be 2 or more. That is, the coating layer may be formed by one coat, or formed by a plurality of coats.

As a sol liquid of the inorganic-organic hybrid material for forming the coating layer, a commercially available product can be used. Examples of the commercially available product of the inorganic-organic hybrid material applicable to the present invention include HB 11 B, HB 21 BN, HB 31 BN and X 11008 (product names) manufactured by Nittobo Medical Co., Ltd.

Other Layers

The transfer member for an image forming apparatus according to the present invention may be provided with not only the above-mentioned base material layer and coating layer but also other layers as long as the effect of the present invention is not impaired. For example, an elastic layer may be provided between the base material layer and the coating layer, or a primer layer containing an adhesive resin may be provided as necessary for improving adhesion between the base material layer and the coating layer.

Examples of the elastic layer include layers formed from a rubber elastic resin, and layers formed from urethane rubber, silicone rubber, fluorine rubber or urethane rubber are preferable.

Transfer Member for Image Forming Apparatus

The transfer member for an image forming apparatus according to the present invention is used as a transfer member in an image forming apparatus. Specifically, the transfer member for an image forming apparatus according to the present invention is preferably an intermediate transfer belt.

It is desirable that the intermediate transfer belt have a seamless shape. The total thickness of the intermediate transfer belt is normally 50 to 150 μm, preferably 50 to 90 μm.

The type of the image forming apparatus to which the transfer member of the present invention is applied is not particularly limited, and examples thereof include copying machines, printers and facsimile equipment.

The transfer member for an image forming apparatus according to the present invention is excellent in transfer property to a recording medium having irregularities on a surface thereof. Examples of the recording medium having irregularities on a surface thereof include embossed paper such as Lezak paper.

The pencil hardness of the transfer member for an image forming apparatus according to the present invention is preferably 4H or more, and more preferably 8H or more from the viewpoint of further excellent transfer property. The pencil hardness in this specification is a value obtained by performing measurement at a coating layer-side surface of the transfer member for an image forming apparatus according to the present invention using a method conforming to JIS K 5600-5-4.

A difference between the surface resistivity of the transfer member for an image forming apparatus according to the present invention and the surface resistivity of the base material layer is preferably $1\times10^{-0.8}$ to $1\times10^{18}$ Ω/□.

In addition, a difference between the volume resistivity of the transfer member for an image forming apparatus according to the present invention and the volume resistivity of the base material layer is preferably $1\times10^{-0.8}$ to $1\times10^{16}$ Ω·cm.

The transfer member for an image forming apparatus according to the present invention includes a coating layer on a base material layer, and a difference between the surface resistivity and volume resistivity thereof and the surface resistivity and volume resistivity of only the base material layer is preferably small. When the difference is small, for example, there is an advantage that the coating layer has only a small influence on the surface resistivity or volume resistivity of the base material layer, and thus the surface resistivity or volume resistivity of the whole transfer member can be adjusted by the addition amount of the conducting agent of the base material layer, leading to facilitation of design.

Preferably, the transfer member for an image forming apparatus according to the present invention has a surface resistivity of $1\times10^{9}$ to $1\times10^{14}$ Ω/□. When the surface resistivity is in the above-mentioned range, the transfer member for an image forming apparatus is excellent in releasability of a residual toner and electrostatic cleaning performance for removing the residual toner by an electrostatic cleaning apparatus, so that more favorable image quality can be attained. The surface resistivity is more preferably $1\times10^{10}$ to $1\times10^{14}$ Ω/□, still more preferably $1\times10^{10}$ to $1\times10^{13}$ Ω/□.

The surface resistivity in this specification is a value measured by a method in an example as described later.

Preferably, the transfer member for an image forming apparatus according to the present invention has a volume resistivity of $1\times10^{8}$ Ω·cm to $1\times10^{14}$ Ω·cm. When the volume resistivity is in the above-mentioned range, the transfer member for an image forming apparatus is excellent in releasability of a residual toner and electrostatic cleaning performance for removing the residual toner by an electrostatic cleaning apparatus, so that more favorable image quality can be attained. The volume resistivity is more preferably $1\times10^{8}$ to $1\times10^{13}$ Ω·cm, still more preferably $1\times10^{8}$ to $1\times10^{12}$ Ω·cm.

The volume resistivity in this specification is a value measured by a method in an example as described later.

Method for Producing Transfer Member for Image Forming Apparatus

The method for producing the transfer member for an image forming apparatus according to the present invention is not particularly limited as long as a transfer member including the base material layer and a coating layer provided on the base material layer can be obtained, and when the transfer member for an image forming apparatus is an intermediate transfer belt, mention is made of, for example, a method including the following steps:

(1) forming a belt-shaped base material layer using a base material layer forming composition; and
(2) forming a coating layer by applying a sol liquid of an inorganic-organic hybrid material to a surface of the belt-shaped base material layer formed in the step (1).

Hereinafter, each step will be described below. Raw materials to be used in the method for producing the transfer member for an image forming apparatus according to the present invention, and the contents thereof are as described above.

Step (1) (Formation of Belt-Shaped Base Material Layer)

In the step (1), a belt-shaped base material layer is formed using a base material layer forming composition. The base material layer can be formed by molding the base material layer forming composition. The molding method is not particularly limited, and a known method may be appropriately selected according to a base material layer forming composition to be used. For example, when a polyimide is used as a resin of the base material layer forming composition, centrifugal molding may be performed, and when a polyamide is used, extrusion molding may be performed. Formation of the base material layer by centrifugal molding and extrusion molding will be described below.

Method for Forming Base Material Layer by Centrifugal Molding of Base Material Layer Forming Composition In the step (1), a base material layer forming composition is subjected to centrifugal molding to form a belt-shaped base material layer. Centrifugal molding can be performed using a cylindrical mold or the like. The use amount of the base material layer forming composition may be adjusted so that the thickness of the resulting base material layer falls within the above-mentioned range.

A method for molding a resin into a seamless belt shape by centrifugal molding is known, and this step (1) can be carried out in accordance with a known centrifugal molding method. Hereinafter, this step (1) will be described by taking as an example a case where a belt-shaped base material layer molded in a belt shape from a polyimide is formed.

Centrifugal molding of the base material layer can be performed by rotating and simultaneously heating a cylindrical mold charged with a base material layer forming composition. By heating, the temperature of the inner surface of the rotating drum (cylindrical mold) is gradually elevated to reach about 100 to 190° C., preferably about 110 to 130° C. (first heating stage). The elevation rate may be, for example, about 1 to 2° C./min. The base material layer forming composition is kept at the above-mentioned temperature for 20 minutes to 2 hours, so that about a half of the solvent is volatilized to form a self-supporting tubular belt. In addition, it is preferable that the rotating speed of the rotating drum in the first heating stage have a centrifugal acceleration which is 0.5 to 10 times as high as the gravitational acceleration. Generally, the gravitational acceleration (g) is 9.8 ($m/s^2$).

The centrifugal acceleration (G) is derived from the following equation (I).

$$G(m/s^2)=r\cdot\omega^2=r\cdot(2\cdot\pi\cdot n)^2 \quad \text{(I)}$$

Where, r is a radius (m) of a cylindrical metal, to is an angular velocity (rad/s), and n is a rotation number per second. From the above equation (I), the rotation condition of the cylindrical mold can be appropriately set.

Next, as second-stage heating, the tubular belt is treated at about 280 to 400° C., preferably about 300 to 380° C. to complete imidization. Here, it is desirable to gradually elevate the temperature to the above-mentioned temperature rather than elevating the temperature to the above-mentioned temperature at a stroke from the first-stage heating temperature. Second-stage heating may be performed with the tubular belt attached to the inner surface of the rotating drum, or after the first heating stage is completed, the tubular belt may be peeled off from the rotating drum, taken out, separately provided to heating means for imidization, and heated to 280 to 400° C. The time required for the imidization is normally about 20 minutes to 3 hours.

In this manner, a belt-shaped base material layer can be formed.

Method for Forming Belt-Shaped Base Material Layer by Extrusion Molding of Base Material Layer Forming Composition In the step (1), a base material layer forming composition is subjected to extrusion molding to form a belt-shaped base material layer. Extrusion molding can be performed using an extruder, a mold (die) or the like. The use amount of the base material layer forming composition may be adjusted so that the thickness of the resulting base material layer falls within the above-mentioned range.

A method for molding a resin into a belt shape by extrusion molding is known, and this step (1) can be carried out in accordance with a known extrusion molding method. Hereinafter, this step (1) will be described by taking as an example a case where a belt-shaped base material layer molded in a belt shape from a polyamide is formed.

First, a polyamide and an optional conducting agent are mixed to prepare a base material layer forming composition. For mixing, known mixing means can be applied, and for example, a twin-screw extruder can be used. When a twin-screw extruder is used, it is preferable that the mixture is heated and kneaded at a barrel temperature of about 160 to 250° C. to be sufficiently dispersed and mixed.

Next, the base material layer forming composition is subjected to extrusion molding. For extrusion molding, known extrusion molding means can be applied, and for example, a single-screw extruder and a circular mandrel die for extrusion molding can be used. The thickness of the resulting base material layer can be adjusted by appropriately setting the lip width of the circular mandrel and extrusion molding conditions. A mandrel such as an air ring may be used at an die outlet in order to accurately hold the shape of the tube after discharge. It is also possible to form an endless belt at a time by installing a circular mandrel die at the tip of a twin-screw extruder.

The base material layer is obtained as a continuous tube by extrusion molding, and therefore when the base material layer is used as an intermediate transfer belt, the base material layer is laterally cut to a necessary width so that it can be used as a belt.

In this manner, a belt-shaped base material layer can be formed.

Step (2) Formation of Coating Layer

A coating layer is formed by applying a coating layer forming composition to a surface of the belt-shaped base material layer formed in the step (1). As the composition for forming the coating layer, mention is made of a sol liquid of an inorganic-organic hybrid material or the like. Preferably, the sol liquid of the inorganic-organic hybrid material contains an alkoxide of a metal or semimetal as an inorganic component, and an organosilicon compound or fluorine-substituted organosilicon compound as an organic component. The inorganic-organic hybrid material is as described above.

Preferably, the coating layer is formed by a sol-gel method using the coating layer forming composition.

Examples of the method for applying a coating layer forming composition to a surface of a belt-shaped base material layer is not particularly limited, and examples thereof include coating methods such as dip coating, spray coating, roll coating and flow coating. The coating amount of the coating layer forming composition may be appropriately adjusted so that the thickness of the resulting coating layer falls within the above-mentioned range.

After the coating layer forming composition is subjected to a heating treatment after being applied to the surface of the base material layer. Heating treatment conditions are not particularly limited as long as a coating layer is formed, and for example, the coating layer forming composition may be subjected to the heating treatment at 80 to 100° C. for 1 to 2 hours. By the heating treatment, the solvent is volatilized to form a coating layer on the base material layer.

In addition, when other layer is further formed, a composition for forming the other layer is prepared, and the other layer is formed by a known method using the composition for forming the other layer.

In this way, the transfer member for an image forming apparatus according to the present invention including a base material layer and a coating layer is produced.

EXAMPLES

Hereinafter, the present invention will be described further in detail by way of examples, but the present invention is in no way limited to the following examples.

Example 1

Production of Intermediate Transfer Belt

In the following procedure, a base material layer and a coating layer were formed, and a seamless intermediate transfer belt was produced.

(Formation of Base Material Layer)

Under circulation of nitrogen, 47.6 g of 4,4'-diaminodiphenyl ether (ODA) was added to 488 g of N-methyl-2-pyrrolidone, and the mixture was kept at 50° C., and stirred to completely dissolve the mixture. To this solution was gradually added 70 g of 3,3',4,4'-biphenyltetracarboxylic dianhydride (BPDA) to obtain 605.6 g of a polyamic acid solution. The polyamic acid solution had a number average molecular weight of 19,000, a viscosity of 43 poise, and a solid content concentration of 18.1% by mass.

Next, 21 g of acidic carbon black (pH 3.0) and 80 g of N-methyl-2-pyrrolidone were added to 450 g of the polyamic acid solution, and carbon black (CB) was uniformly dispersed by a ball mill to obtain a base material layer forming composition. The solid content concentration in the base material layer forming composition was 18.5% by mass, and the carbon black concentration in the solid content was 21.6% by mass. 273 g of the base material layer forming composition was injected into a rotating drum, and deposited under the following conditions.

Rotating drum: A metal drum having a mirror-finished inner surface and having an inner diameter of 301.5 mm and a width of 540 mm was disposed in such a manner that the metal drum was placed on two rotating rollers, and rotated with rotation of the rollers.

Heating temperature: A far-infrared heater was disposed on the outer surface of the drum and controlled, so that the inner surface temperature of the drum was set to 120° C.

First, 273 g of the base material layer forming composition was uniformly applied to the inner surface of the drum while the rotating drum was rotated, and heating was started. The heating was performed at a temperature of 120° C. while rotation was maintained at this temperature for 60 minutes after the temperature was elevated to this temperature at a rate of 1° C./min After completion of the rotation and heating, the rotating drum was removed as it is without being cooled, and was left standing in a hot air retention type oven, and heating for imidization was started. In this heating, the temperature was gradually elevated to 320° C. The base material layer forming composition was heated at this temperature for 30 minutes, and then cooled to ordinary temperature, and a base material layer formed on the inner surface of the drum was peeled off, and taken out. The resulting belt-shaped base material layer had a thickness of 79.5 μm, an outer peripheral length of 944.2 mm, a surface resistivity of $1\times10^{10.0}$ Ω/□, and a volume resistivity of $1\times10^{10.3}$ Ω·cm.

(Lamination of Coating Layer)

"HB 11 B" (product name, inorganic-organic hybrid, solid content: 24% by mass, manufactured by Nittobo Medical Co., Ltd.) as an inorganic-organic hybrid material was provided as a coating layer forming composition. As shown in FIG. 1, the base material layer 3 obtained as described above was then placed on the outer peripheral surface of a cylindrical mold 4, and a liquid bath 2 containing a coating layer forming composition 1 was moved on the outer peripheral surface to apply the coating layer forming composition 1 to the outer surface of the base material layer 3 (dipping method). Under an air atmosphere, the coating layer forming composition was fired at 100° C. for 60 minutes to prepare an intermediate transfer belt including a base material layer and a coating layer, the coating layer having a thickness of 1.8 μm.

Example 2

An intermediate transfer belt was produced by the same method as in Example 1 except that "HB 21 BN" (product name, inorganic-organic hybrid, solid content: 24% by mass, manufactured by Nittobo Medical Co., Ltd.) was used in place of "HB 11 B", and the thickness of the coating layer was 1.1 μm.

Example 3

An intermediate transfer belt was produced by the same method as in Example 1 except that "HB 21 BN" (product name, inorganic-organic hybrid, solid content: 24% by mass, manufactured by Nittobo Medical Co., Ltd.) was used in place of "HB 11 B", and the thickness of the coating layer was 2.2 μm.

Example 4

An intermediate transfer belt was produced by the same method as in Example 1 except that the carbon black concentration in the base material layer forming composition was 22.7% by mass, "HB 21 BN" (product name, inorganic-organic hybrid, solid content: 24% by mass, manufactured by Nittobo Medical Co., Ltd.) was used in place of "HB 11 B", and the thickness of the coating layer was 2.2 μm.

Example 5

An intermediate transfer belt was produced by the same method as in Example 1 except that the carbon black concentration in the base material layer forming composition was 20.1% by mass, "HB 21 BN" (product name, inorganic-organic hybrid, solid content: 24% by mass, manufactured by Nittobo Medical Co., Ltd.) was used in place of "HB 11 B", and the thickness of the coating layer was 2.1 μm.

Example 6

An intermediate transfer belt was produced by the same method as in Example 1 except that "HB 21 BN" (product name, inorganic-organic hybrid, solid content: 24% by mass, manufactured by Nittobo Medical Co., Ltd.) was used in place of "HB 11 B", and the thickness of the coating layer was 6.1 μm.

Example 7

An intermediate transfer belt was produced by the same method as in Example 1 except that "HB 21 BN" (product name, inorganic-organic hybrid, solid content: 24% by mass, manufactured by Nittobo Medical Co., Ltd.) was used in place of "HB 11 B", and the thickness of the coating layer was 8.1 μm.

Example 8

An intermediate transfer belt was produced by the same method as in Example 1 except that "HB 21 BN" (product name, inorganic-organic hybrid, solid content: 24% by mass, manufactured by Nittobo Medical Co., Ltd.) was used in place of "HB 11 B", and the thickness of the coating layer was 9.2 μm.

Example 9

(Formation of Base Material Layer)

100 parts by mass of a polyamide resin (PA 12, 3020 U, manufactured by Ube Industries, Ltd.), to which 20 parts by mass of carbon black was added, was compounded at a head temperature of 200° C. by a φ30 mm twin-screw extruder to produce raw material pellets. The raw material pellets were subjected to extrusion molding at screw L/D ratio of 25, a die diameter of Φ200 mm, a die gap of 0.135 and a die temperature of 210° C. in a φ50 mm extruder to form a seamless belt having an outer diameter of φ180 mm, a thickness of 120 μm, a surface resistivity of $1\times10^{10.4}$ Ω/□ and a volume resistivity of $1\times10^{10.6}$ Ω·cm.

(Lamination of Coating Layer)

The belt obtained by the extrusion molding was used as a base material layer. By the same method as in Example 1, a coating layer having a thickness of 1.5 μm was formed on the base material layer to produce an intermediate transfer belt.

Example 10

An intermediate transfer belt was produced by the same method as in Example 9 except that the thickness of the coating layer was 3.1 μm.

Example 11

An intermediate transfer belt was produced by the same method as in Example 1 except that "HB 31 BN" (product name, inorganic-organic hybrid, manufactured by Nittobo Medical Co., Ltd.) was used in place of "HB 11 B", and the thickness of the coating layer was 7.2 μm.

Example 12

An intermediate transfer belt was produced by the same method as in Example 1 except that "X 11008" (product name, inorganic-organic hybrid, manufactured by Nittobo Medical Co., Ltd.) was used in place of "HB 11 B", and the thickness of the coating layer was 3.2 μm.

Comparative Example 1

An intermediate transfer belt was produced by the same method as in Example 1 except that a coating layer was not provided on a base material layer.

Comparative Example 2

An intermediate transfer belt was produced by the same method as in Example 1 except that a coating layer having a thickness of 1.1 μm was formed using "BC 101•BN" (product name, inorganic type, manufactured by BIANCO JAPAN Co., Ltd.) in place of "HB 11 B".

Comparative Example 3

An intermediate transfer belt was produced by the same method as in Example 1 except that a coating layer having a thickness of 0.5 μm was formed using "HB 21 BN" (product name, inorganic-organic hybrid, manufactured by Nittobo Medical Co., Ltd.) in place of "HB 11 B".

Comparative Example 4

An intermediate transfer belt was produced by the same method as in Example 1 except that a coating layer having a thickness of 1.4 μm was formed using "No. 700" (product name, inorganic-organic hybrid, manufactured by INORGANIC Co., Ltd.) in place of "HB 11 B".

Comparative Example 5

An intermediate transfer belt was produced by the same method as in Example 1 except that a coating layer having a thickness of 5.3 μm was formed using "TR-101" (product name, fluorine type, manufactured by DIC Corporation) in place of "HB 11 B".

Comparative Example 6

An intermediate transfer belt was produced by the same method as in Example 1 except that a coating layer having a thickness of 3.3 μm was formed using "6FH-021" (product name, acrylic type, manufactured by DAIKIN INDUSTRIES, Ltd.) in place of "HB 11 B".

Comparative Example 7

An intermediate transfer belt was produced by the same method as in Example 9 except that a coating layer was not provided on a base material layer.

The intermediate transfer belt obtained in each of examples and comparative examples was evaluated by the following method. The results are shown in Table 1. The inorganic-organic hybrid materials used in examples and comparative examples are "No. 700", "HB 11 B", "HB 21 BN", "HB 31 BN" and "X 11008" in the descending order in terms of the inorganic component content.

[Martens Hardness (Microhardness)]

Using a dynamic ultra-microhardness meter (DUH-211S manufactured by Shimadzu Corporation), the hardness (ISO 14577-1 Martens hardness) of a coating layer-side surface of the intermediate transfer belt at an indentation depth of 0.05 μm was measured under the following conditions. Here, for obtaining Martens hardness data exactly at an indentation depth of 0.05 μm, the slope and the intercept of the straight line were calculated from a plot between two points before and after the 0.05 μm indentation depth by a least squares method, and the hardness was calculated. For the hardness at each indentation depth, measurements were made at five different surface portions in the same belt, and the average thereof was defined as a Martens hardness.

Tester: Shimadzu dynamic ultra-microhardness meter DUH-211S
Test mode: indentation depth set loading-unloading test
Minimum test force: 0.02 mN
Loading rate: 1.4632 mN/sec
Load holding time: 2 seconds
Unloading retention time: 0 second
Set indentation depth: 0.05 μm
Test force range: 19.6133 mN
Indenter type: Triangular 115 (diamond triangular pyramid indenter having an edge-to-edge angle of 115°, Berkovich type)

[Measurement of Surface Resistivity and Volume Resistivity]

The surface resistivity and the volume resistivity of the resulting intermediate transfer belt were measured under the following conditions. Values in Table 1 each indicate n of "$1\times10^{n}$ (Ω/□ or Ω·cm)". In the table, "over" indicates that n is greater than 14.

Apparatus: Hiresta IP • HR Probe (manufactured by Mitsubishi Chemical Corporation)
Applied voltage: surface resistance: 100 V, volume resistance: 10 V
Measurement point: Values 10 seconds after voltage application were measured at total 12 points (3 points in the belt width direction×4 points in the circumferential direction) on a coating layer-side surface of the intermediate transfer belt, and the average thereof was calculated.

[Secondary Transfer Property]

For evaluating the secondary transfer property of each intermediate transfer belt, the following test was conducted using plain paper and embossed paper ("Lezak 66" manufactured by Fuji Xerox Office Supplies Company, surface irregularity difference: 80 μm, 151 g/m$^2$). A solid image of C (cyan) color was printed on each intermediate transfer belt, and the weight of the toner on the transfer belt was measured before and after printing. The secondary transfer efficiency was then determined from the following equation, and secondary transfer property was evaluated in accordance with the following assessment criteria.

$$\text{Transfer efficiency (\%)}=100\times[(\text{weight of toner before transfer})-(\text{weight of toner after transfer})]/(\text{weight of toner before transfer})] \quad \text{[Mathematical Formula 1]}$$

<Assessment Criteria for Secondary Transfer Property>

⊙: The secondary transfer efficiency is 99% or more.
○: The secondary transfer efficiency is 95% or more and less than 99%.
Δ: The secondary transfer efficiency is 90% or more and less than 95%.
×: The secondary transfer efficiency is less than 90%.

[Durability]

An intermediate transfer belt was set in a copying machine, driving tests corresponding, respectively, to 50,000, 150,000 and 300,000 copies were conducted, and the belt surface after the test was observed. The endurance test was ended at the time when cracks were generated on the belt surface. The time point at which cracks were generated was determined in accordance with the following criteria, and durability was evaluated.

○: Equivalent to 300,000 copies.
Δ: Equivalent to 150,000 copies.
×: Equivalent to 50,000 copies.

[Pencil Hardness]

The pencil hardness of a coating layer-side surface of the intermediate transfer belt was measured by a method conforming to JIS-K 5600-5-4.

TABLE 1

| | Coating layer | | Base material | | Secondary transfer property | | |
|---|---|---|---|---|---|---|---|
| | Component | Thickness (μm) | layer Material | Microhardness mN/mm$^2$ | Plain paper | Lezak paper | Durability |
| Example 1 | Inorganic-organic hybrid | 1.8 μm | Polyimide | 591 | ⊙ | ⊙ | ○ |
| Example 2 | Inorganic-organic hybrid | 1.1 μm | Polyimide | 308 | ⊙ | ⊙ | ○ |
| Example 3 | Inorganic-organic hybrid | 2.2 μm | Polyimide | 325 | ⊙ | ⊙ | ○ |
| Example 4 | Inorganic-organic hybrid | 2.2 μm | Polyimide | 319 | ⊙ | ⊙ | ○ |
| Example 5 | Inorganic-organic hybrid | 2.1 μm | Polyimide | 329 | ⊙ | ⊙ | ○ |
| Example 6 | Inorganic-organic hybrid | 6.1 μm | Polyimide | 328 | ⊙ | ⊙ | ○ |
| Example 7 | Inorganic-organic hybrid | 8.1 μm | Polyimide | 335 | ⊙ | ⊙ | Δ |
| Example 8 | Inorganic-organic hybrid | 9.2 μm | Polyimide | 335 | ⊙ | ⊙ | Δ |
| Example 9 | Inorganic-organic hybrid | 1.5 μm | Polyamide | 195 | ⊙ | ⊙ | ○ |
| Example 10 | Inorganic-organic hybrid | 3.1 μm | Polyamide | 233 | ⊙ | ⊙ | ○ |
| Example 11 | Inorganic-organic hybrid | 7.2 μm | Polyimide | 225 | ○ | Δ | Δ |
| Example 12 | Inorganic-organic hybrid | 3.2 μm | Polyimide | 148 | ○ | Δ | ○ |
| Comparative Example 1 | None | — | Polyimide | 423 | ○ | X | — |
| Comparative Example 2 | Inorganic type | 1.1 μm | Polyimide | 930 | Δ | X | X |
| Comparative Example 3 | Inorganic-organic hybrid | 0.5 μm | Polyimide | 123 | ○ | X | ○ |
| Comparative Example 4 | Inorganic-organic hybrid | 1.4 μm | Polyimide | 114 | X | X | ○ |
| Comparative Example 5 | Fluorine type | 5.3 μm | Polyimide | 113 | X | X | ○ |
| Comparative Example 6 | Acrylic type | 3.3 μm | Polyimide | 105 | X | X | ○ |
| Comparative Example 7 | None | — | Polyamide | 103 | X | X | — |

| | | Coating layer + base material | | Base material | | (Coating layer + base material)-base material | |
|---|---|---|---|---|---|---|---|
| | Pencil hardness | Surface resistivity (Ω/□) | Volume resistivity (Ω · cm) | Surface resistivity (Ω/□) | Volume resistivity (Ω · cm) | Surface resistivity (Ω/□) | Volume resistivity (Ω · cm) |
| Example 1 | 9H | 10.8 | 10.1 | 10.0 | 10.3 | 0.8 | −0.2 |
| Example 2 | 8H | 11.0 | 9.9 | 10.0 | 10.3 | 1.0 | −0.4 |
| Example 3 | 8H | 11.0 | 9.7 | 10.0 | 10.3 | 1.0 | −0.6 |
| Example 4 | 8H | 9.4 | 10.0 | 9.1 | 8.6 | 0.3 | −1.4 |
| Example 5 | 8H | 11.4 | 11.0 | 12.0 | 11.2 | −0.6 | −0.2 |
| Example 6 | 8H | 11.1 | 9.9 | 10.0 | 10.3 | 1.1 | −0.4 |
| Example 7 | 8H | 11.1 | 10.0 | 10.0 | 10.3 | 1.1 | −0.3 |
| Example 8 | 8H | 11.1 | 10.0 | 10.0 | 10.3 | 1.1 | −0.3 |
| Example 9 | 8H | 11.0 | 10.7 | 10.4 | 10.6 | 0.6 | 0.1 |
| Example 10 | 8H | 11.1 | 10.9 | 10.6 | 10.9 | 0.5 | 0.0 |
| Example 11 | 6H | 11.6 | 10.8 | 10.0 | 10.3 | 1.6 | 0.5 |
| Example 12 | 4H | 11.4 | 10.4 | 10.0 | 10.3 | 1.4 | 0.1 |
| Comparative Example 1 | — | — | — | 10.0 | 10.3 | — | — |
| Comparative Example 2 | 9H or more | 10.8 | over* | 10.0 | 10.3 | 0.8 | — |
| Comparative Example 3 | 8H | 10.7 | 11.3 | 10.0 | 10.3 | 0.7 | 1.0 |
| Comparative Example 4 | 3H | 11.9 | 12.2 | 10.0 | 10.3 | 1.9 | 1.9 |
| Comparative Example 5 | 4H or less | over* | over* | 10.0 | 10.3 | — | — |
| Comparative Example 6 | 4H or less | 13.3 | 13.8 | 10.0 | 10.3 | 3.3 | 3.5 |
| Comparative Example 7 | — | — | — | 10.6 | 10.7 | — | — |

*"over" indicates a value greater than 14.

From Table 1, it was found that the intermediate transfer belts of examples were excellent in secondary transfer property to the Lezak paper. In addition, it was found that intermediate transfer belts of examples were also excellent in durability. Further, it was found that the difference in surface resistivity and volume resistivity between the base material layer and the coating layer was small.

INDUSTRIAL APPLICABILITY

The transfer member for an image forming apparatus according to the present invention can be applied to a transfer member for an image forming apparatus using an electrophotography method, such as a digital printing machine, a copying machine or a laser beam printer.

DESCRIPTION OF REFERENCE SIGNS

1: Coating layer forming composition
2: Liquid bath
3: Base material layer
4: Mold

The invention claimed is:

1. A transfer member for an image forming apparatus comprising:

a base material layer; and a coating layer provided on a surface of the base material layer and composed of an inorganic-organic hybrid material, the coating layer having a thickness of 10 μm or less, the coating layer having a surface having a microhardness from 140 to 600 $mN/mm^2$ or more as measured at an indentation depth of 0.05 μm with a Berkovich indenter by a method conforming to ISO 14577-1, wherein a difference between a surface resistivity of the coating layer and a surface resistivity of the base material layer is $1\times10^{-0.8}$ to $1\times10^{1.8}$ Ω/□ and wherein a difference between a volume resistivity of the coating layer and a volume resistivity of the base material layer is $1\times10^{-0.8}$ to $1\times10^{1.6}$ Ω·cm.

2. The transfer member for an image forming apparatus according to claim 1, wherein the inorganic-organic hybrid material is obtained by reaction of an alkoxide of a metal or semimetal with an organosilicon compound or a fluorine-substituted organosilicon compound.

3. The transfer member for an image forming apparatus according to claim 1, wherein the surface of the coating layer has a pencil hardness of 4H or more.

4. The transfer member for an image forming apparatus according to claim 1, wherein a resin that forms the base material layer is at least one selected from the group consisting of a polyimide, a polyamideimide and a polyamide.

5. The transfer member for an image forming apparatus according to claim 1, wherein the base material layer has a thickness of 30 to 160 μm.

6. The transfer member for an image forming apparatus according to claim 1, which has a surface resistivity is $1\times10^{9}$ to $1\times10^{14}$ Ω/□.

7. The transfer member for an image forming apparatus according to claim 1, which has a volume resistivity of $1\times10^{8}$ to $1\times10^{14}$ Ω·cm.

8. A method for producing the transfer member for an image forming apparatus according to claim 1, the method comprising the following steps (1) and (2):

(1) forming a belt-shaped base material layer using a base material layer forming composition; and (2) forming a coating layer by applying a sol liquid of an inorganic-organic hybrid material to a surface of the belt-shaped base material layer formed in step (1).

9. A method of transferring an image onto a recording medium in an image forming apparatus, comprising using a laminate, the laminate including a base material layer, and a coating layer provided on a surface of the base material layer and composed of an inorganic-organic hybrid material, the coating layer having a thickness of 10 μm or less, the coating layer having a surface having a microhardness from 140 to 600 $mN/mm^2$ or more as measured at an indentation depth of 0.05 μm with a Berkovich indenter by a method conforming to ISO 14577-1, wherein a difference between a surface resistivity of the coating layer and a surface resistivity of the base material layer is $1\times10^{-0.8}$ to $1\times10^{1.8}$ Ω/□ and wherein a difference between a volume resistivity of the coating layer and a volume resistivity of the base material layer is $1\times10^{-0.8}$ to $1\times10^{1.6}$ Ω·cm.

* * * * *